United States Patent [19]

Bottomore et al.

[11] Patent Number: 4,660,463

[45] Date of Patent: Apr. 28, 1987

[54] ROOF SPACE VENTILATOR

[75] Inventors: David Bottomore, Meltham; Paul Bottomore, South Normanton, both of England

[73] Assignee: Glidevale Building and Products, Ltd., England

[21] Appl. No.: 735,364

[22] Filed: May 17, 1985

[51] Int. Cl.[4] ..... F24F 7/00; F24F 13/00

[52] U.S. Cl. ..... 98/37; 52/92; 52/95

[58] Field of Search ..... 98/37, 32, DIG. 6; 52/22, 90, 92, 95, 198, 199

[56] References Cited

U.S. PATENT DOCUMENTS

| | | | |
|---|---|---|---|
| 3,863,553 | 2/1975 | Koontz | 52/198 X |
| 4,096,790 | 6/1978 | Curran | 98/37 |
| 4,189,878 | 2/1980 | Fitzgerald | 98/37 X |
| 4,214,510 | 7/1980 | Ward | 98/37 |
| 4,223,489 | 9/1980 | Bentley | 52/92 |

FOREIGN PATENT DOCUMENTS

| | | |
|---|---|---|
| 2088924B | 11/1983 | United Kingdom . |
| 2070662B | 2/1984 | United Kingdom . |
| 2127060A | 4/1984 | United Kingdom . |

*Primary Examiner*—Lloyd L. King

*Attorney, Agent, or Firm*—Poms, Smith, Lande & Rose

[57] ABSTRACT

A ventilator for use in a roof structure comprises ventilation means having at least one channel through which air can flow, and support means adapted to support the ventilation means. The ventilation means and support means define a substantially fixed acute angle therebetween. A flexible member is provided on at least one of the support means and the ventilation means, and is adapted to be flexed to adjust the orientation of the ventilation means and the support means.

8 Claims, 7 Drawing Figures

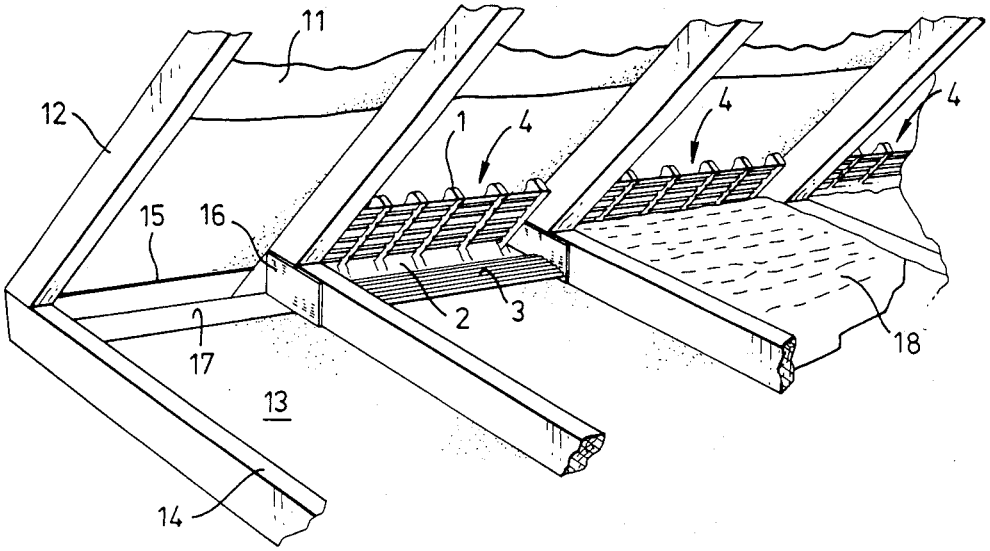
Fig. 4.
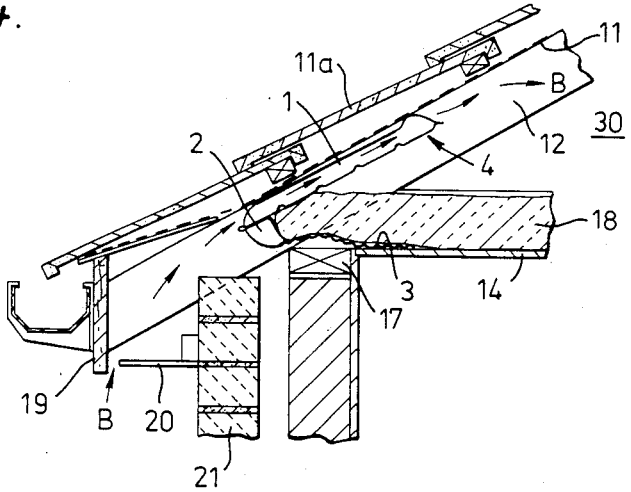
Fig. 5.
Fig. 6.
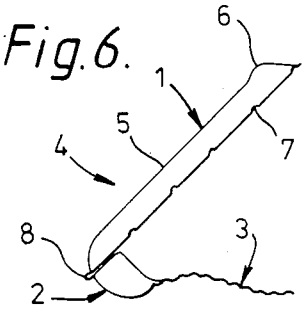
Fig. 7.
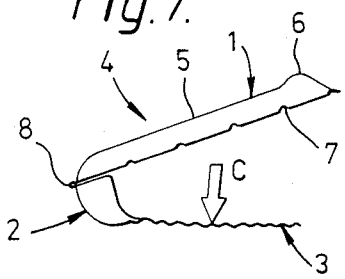

ROOF SPACE VENTILATOR

BACKGROUND OF THE INVENTION

This invention relates to a roof space ventilator.

The continuing awareness within the building industry of the energy crisis has led to an increasing use of high levels of insulation in houses, and particularly in roof spaces.

The use of high levels of insulation in roof spaces has two principle effects. Firstly, the temperature of the roof becomes colder leading to increased condensation; and secondly, ventilation of the roof space through the eaves of the house is impeded by the insulation. In view of this it is essential to ensure that an adequate ventilation path is maintained for atmospheric air through the eaves into and out of the roof space.

Further problems may arise when using loose felt or granulated insulation materials which have to be prevented from ingress to the eaves by a physical barrier of some kind.

There are ventilators available which try to provide an air passageway through the eaves and similtaneously prevent the ingress of insulating material into the eaves.

An example of such a ventilator is described in United Kingdom patent specification No. 2,070,662B. The ventilator described in this specification is foldable and has two portions which have to be secured to the rafters and the roof joists in order to maintain the ventilator in position. Installation of this ventilator can be time consuming because it is necessary to align correctly the portions with the joists and rafters before they can be secured thereto.

Another ventilator is described in United Kingdom patent specification No. 2,088,924B. This ventilator is subject to similar problems to the ventilator described above.

Similar ventilators are described in, for example, U.S. Pat. Nos. 3,863,553, 4,069,628 and 4,189,878.

More advanced ventilators have been developed which have a plurality of elongate ribs extending parallel to the air flow path so that air may flow between adjacent ribs. Examples of such ventilators are described in U.S. Pat. Nos. 3,972,164 and 3,797,180, in United Kingdom patent application No. 2,127,060A, and in International patent application No. WO 80/01702. Problems can arise with these ventilators. If the spacing between the ribs is too large then the sarking felt can sag between the ribs and obstruct the ribs. If the spacing is reduced to avoid this problem then the air flow is obstructed by the large number of ribs. Furthermore these ventilators are not strong enough to withstand the loading applied to the sarking felt and are not adapted to prevent the ingress of insulation material to the eaves.

None of the ventilators described in the above specifications are easy to install in the roof structure, and many of them cannot be installed in buildings after the roof structures have been constructed.

SUMMARY OF THE INVENTION

It is an object of the invention to provide a roof space ventilator which can effectively ventilate a roof space.

It is a further object of the invention to provide a roof space ventilator capable of withstanding loadings applied by the material of a roof structure.

It is a further object of the invention to provide a roof space ventilator which is of simple construction, economical to manufacture and easily installed in a roof structure.

It is a further object of the invention to provide a ventilator which can prevent the ingress of insulation material to the eaves of a roof structure.

According to one aspect of the invention there is provided a ventilator for use in a roof structure comprising ventilation means having at least one channel through which air can flow, support means adapted to support the ventilation means, said ventilation means and support means defining a substantially fixed acute angle therebetween, and a flexible member provided on at least one of the support means and the ventilation means, said flexible member being adapted to be flexed to adjust the orientation of the ventilation means and the support means.

This enables the ventilator to be accommodated in roofs of differing roof pitches.

Preferably the ventilation means, the support means and flexible member define a space therebetween for receiving insulation material.

Desirably the ventilation means comprises a base member having a plurality of ribs defining the or each air flow channel therebetween.

Advantageously the flexible member comprises an arcuate sheet and is preferably provided with transverse corrugations. Advantageously also the flexible member comprises a resilient material.

In one embodiment the ventilation means is formed separately from the support means and the flexible member. The support means may then be attached to the ventilation means by any suitable means, such as by stapling or by adhesive.

In an alternative embodiment the ventilator is integrally formed with a hinge between the ventilation means and the support means. The ventilation means may be rotated about the hinge relative to the support means and the flexible member until it abuts a surface of the support means. The ventilation means and the support means may then be rigidly connected by any suitable means, such as by stapling or by adhesive.

The ventilator is desirably made from a thermoplastics material and is preferably vacuum formed.

According to another aspect of the invention there is provided a roof structure comprising a roof space defined by a roof ceiling and a roof floor, an air passageway into and out of the roof space, insulation material laid over the roof floor, and a ventilator as described above, wherein the ventilation means engages the roof ceiling, the support means and the flexible member engage the roof floor, and the insulation material adjacent an edge of the roof floor overlies at least part of the support member and the flexible member.

The ventilator according to the invention is self supporting and hence easier to install in a roof space than prior ventilators. In addition there is no necessity for the provision of means to fix the ventilator to the roof structure. Furthermore the ventilator can not be pushed through the edge of the roof space into the eaves. Because the orientation of the ventilation means and support means is adjustable, the ventilator can be used with different roofs over a wide range of roof pitches.

BRIEF DESCRIPTION OF THE DRAWINGS

Reference is now made to the accompanying drawings in which:

FIG. 4 is a perspective view from the inside of a roof spacing showing the ventilator of FIG. 1 in position in a roof structure;

FIG. 5 is a cross-section of a roof structure showing the ventilator of FIG. 1 in position in the roof structure; and FIGS. 6 and 7 are cross-sections of a roof space ventilator according to the invention having different orientations.

DESCRIPTION OF THE PREFERRED EMBODIMENTS

Figure 1:
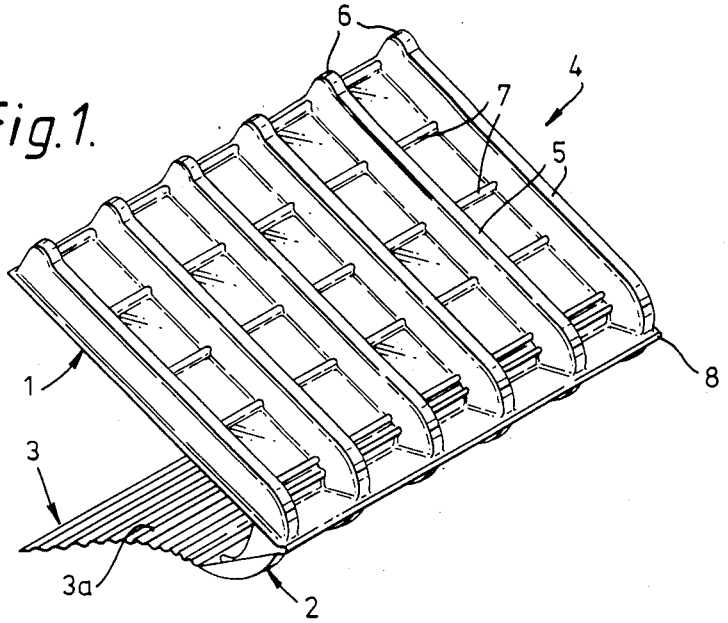
FIG. 1 is a perspective view of a roof space ventilator according to the invention.

In FIG. 1 a ventilator generally designated 4, comprises ventilation means 1, support means 2, and a flexible member 3.

Figure 2:
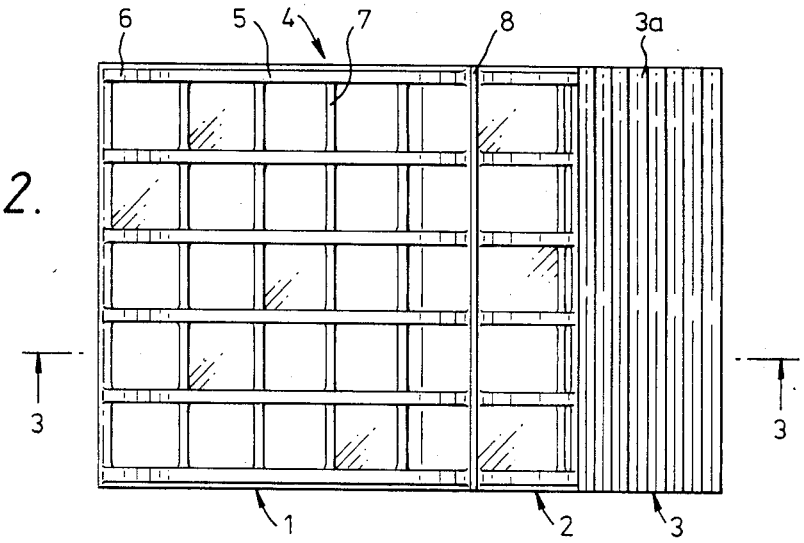
FIG. 2 is a plan view of a ventilator according to the invention prior to complete assembly.

The ventilation means 1 is provided with ribs 5 which have raised ends 6; the ribs define air flow channels therebetween. In order to increase the rigidity of the ventilation means 1, strengthening ribs 7 are provided transverse to ribs 5. The flexible member 3 is provided with transverse corrugations 3*a*. As can be seen from FIG. 2, the ribs 5 also extend along the support means 2.

Figure 3:
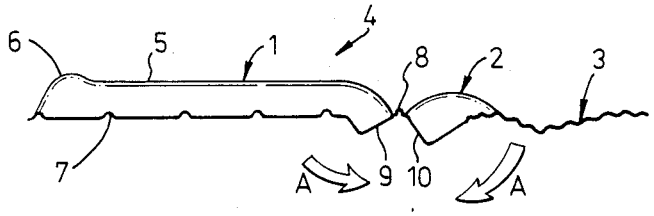
FIG. 3 is a section along the line 3—3 of FIG. 2.

The ventilator 4 may be integrally formed by vacuum forming a thermoplastics material. In this instance the ventilator 4 is advantageously provided with a manufacturing hinge 8, which connects the ventilation means 1 with the support means 2. The manufacturing hinge 8 allows flexibility between the ventilation means 1 and the support means 2. In order to complete assembly, the ventilation means and the support means are rotated about the hinge in opposite directions, as shown by arrows 'A' in FIG. 3.

The rotation is continued until a surface 9 of the ventilation means 1 engages a surface 10 of the support means 2.

The surface 9 of the ventilation means 1 may be rigidly secured to the surface 10 by, for example, stapling or by adhesive.

FIGS. 4 and 5 show the ventilator 4 installed in a roof structure which encloses a roof space 30. The roof structure includes a roof ceiling, comprising roof tiles 11*a* and sarking felt 11, which is supported by rafters 12. The roof structure also includes a roof floor 13, which is situated below joists 14. The ventilator 4 is located at the edge of the roof space adjacent a tilting piece 15 and a trevis piece 16 over a wall plate 17. An insulating material 18 is laid over the roof floor 13 and at its edges overlies the support means 2 and the flexible member 3 of the ventilator 4.

The insulating material 18 is received in the space defined by the ventilation means 1, the support means 2 and the flexible member 3. This prevents the insulating material 18 from extending into the eaves of the roof structure. This is particularly important when the insulating material 18 is of a particulate nature.

In FIG. 5 an outer wall 21 is shown to which a soffite board 20 is secured at the eaves of the roof structure. A fascia board 19 is secured to an end of the rafters 12 so that a gap is provided between the fascia board 19 and the soffite board 20.

Air can enter the roof space 30 from the eaves by flowing between the fascia board 19 and the soffite board 20, and through the air flow channels in the ventilation means 1. The air flow path into the roof space 30 is indicated by the arrows 'B'.

FIGS. 6 and 7 show how the flexible member 3 of the ventilator 4 can be flexed in order to adjust the inclination of the ventilation means 1 and the support means 2. As shown in FIG. 7 the application of pressure to the flexible member 3 in the direction indicated by arrow 'C' causes the orientation of the ventilation means 1 and the support means 2 to alter relative to the flexible member 3.

The ventilator 4 can easily be installed in the roof space 30 from within the roof space. When the ventilator 4 is pushed into position the flexible member 3 automatically flexes in order to adjust the orientation of the ventilation means 1 and the support means 2 to match the inclination of the roof ceiling with respect to the roof floor 13.

The ventilation means 1 may also be provided with a mesh across the ribs (not shown) in order to prevent the ingress of insects into the roof space through the air passageway formed by the ventilator 4.

We claim:

1. A ventilator for use in a roof structure comprising:
   - a base member;
   - a plurality of ribs affixed to said base member and extending above said base member forming a plurality of ventilation channels;
   - a plurality of strengthening ribs positioned at an angle to said ribs on said base member;
   - support means affixed to said base member for supporting said base member at an acute angle;
   - a flexible member extending from said support means for adjusting the orientation of said base member and said support means.

2. The ventilator of claim 1 further comprising:
   - a means for rotating said support means to a fixed acute angle with respect to said base member.

3. The ventilator of claim 2 wherein said means for rotating further comprises a manufacturing hinge.

4. The ventilator of claim 1 wherein said flexible member further comprises a plurality of transverse corrugations.

5. The ventilator of claim 4 wherein said flexible member further comprises an arcuate sheet.

6. The ventilator of claim 1 wherein said support means further comprises a plurality of ribs extending from said base member along a portion of said support means.

7. The ventilator of claim 1 wherein said flexible member comprises a resilient material.

8. A roof structure having a roof space defined by a roof ceiling and a roof floor, a ventilation path in the roof space, insulation material placed on the roof floor and a ventilator comprising:
   - a base member engaging said roof ceiling;
   - a plurality of ribs affixed to said base member and extending above said base forming at least one ventilation channel between said base and said roof ceiling communicating with said ventilation path;
   - a plurality of strengthening ribs positioned at an angle to said ribs on said base member;
   - support means affixed to said base member for supporting said base member at an acute angle; and
   - a flexible member extending said said support means for adjusting the orientation of said base member and said support means wherein said insulation material overlies at least a portion of said support means and said flexible member.

* * * * *